US009027455B1

(12) United States Patent
Woodall et al.

(10) Patent No.: US 9,027,455 B1
(45) **Date of Patent: *May 12, 2015**

(54) SLURRY LINE CHARGE MINE CLEARANCE SYSTEM AND METHOD

(71) Applicant: The United States of America as represented by the Secretary of the Navy, Washington, DC (US)

(72) Inventors: Robert C Woodall, Panama City, FL (US); Gregory A Reitmeyer, Panama City, FL (US); Felipe A Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/669,725

(22) Filed: Nov. 6, 2012

(51) Int. Cl.
*F41H 11/14* (2006.01)

(52) U.S. Cl.
CPC ..... *F41H 11/14* (2013.01)

(58) Field of Classification Search
CPC ..... F41H 11/12; F41H 11/14; F41H 11/16
USPC ..... 89/1.13; 701/2; 149/60; 102/402, 403; 318/568.11, 581, 587; 86/50
See application file for complete search history.

(56) References Cited

U.S. PATENT DOCUMENTS

| | | | | |
|---|---|---|---|---|
| 3,638,569 | A * | 2/1972 | Thomanek | 102/403 |
| 4,823,672 | A * | 4/1989 | Eidelman | 89/1.13 |
| 6,152,010 | A * | 11/2000 | Mixon et al. | 89/1.13 |
| 7,331,436 | B1 * | 2/2008 | Pack et al. | 191/12.2 A |
| 8,714,069 | B1 * | 5/2014 | Woodall et al. | 89/1.13 |
| 2002/0156556 | A1 * | 10/2002 | Ruffner | 701/23 |
| 2007/0018602 | A1 * | 1/2007 | Vlaar et al. | 318/587 |
| 2012/0137862 | A1 * | 6/2012 | Kossett et al. | 89/1.13 |

* cited by examiner

*Primary Examiner* — Samir Abdosh
*Assistant Examiner* — John D Cooper
(74) *Attorney, Agent, or Firm* — James T. Shepherd

(57) ABSTRACT

A mine clearing system and method remotely deploys line hose from a remotely controlled two-wheeled vehicle. The wheels are connected together via a central hub shaft. Individual battery operated hub motors on each wheel communicate to a central controller inside the hub shaft. The power source for the motors is contained within the hub shaft, with battery recharge ports located on the hub shaft. The line hose is wrapped around the central hub shaft. An operator uses a remote control console in communication with the central controller to independently control each wheel of the vehicle. A camera can hang from a hub shaft bearing on the outside of one wheel so as to be gravitationally stabilized during vehicle movement. The camera can broadcast signals to a display at the remote control console. Explosive slurry is pumped into the line hose and detonated.

15 Claims, 4 Drawing Sheets

SLURRY LINE CHARGE MINE CLEARANCE SYSTEM AND METHOD

STATEMENT OF GOVERNMENT INTEREST

The invention described herein may be manufactured and used by or for the Government of the United States of America for governmental purposes without the payment of any royalties.

CROSS REFERENCE TO OTHER PATENT APPLICATIONS

This patent application is related to co-pending patent application entitled MINE CLEARANCE SYSTEM AND METHOD, Ser. No. (TBD; Navy Case No. 101788), filed (TBD), said co-pending application being by the same inventors as this application.

BACKGROUND OF THE INVENTION (1) Field of the Invention

The present invention relates to mine clearance. More particularly, the present invention relates to systems and methods to remotely emplace explosive charges along a path suspected of being mined with explosive devices and to neutralize the suspected devices by detonating the system's explosive charges.

(2) Description of the Prior Art

Currently, a number of peace-keeping forces are engaged in overseas contingency operations that often involve terrorist or insurgent actions that make use of mines or improvised explosive devices (IEDs) along roadways to hamper operations, kill and maim forces and induce terror. To counter these hazards, peace-keeping forces need a means to quickly, safely and effectively clear and neutralize mines and IEDs.

Some forces have used mine rollers and mine plows to dig up and detonate these hazards. However, in heavily mined areas these forces experience a situation where they soon run out of spare parts for damaged or destroyed roller and plow hardware. In other cases, forces have made use of systems using ballistic rocket deployed line charges to clear roadways. However, the flight of the ballistic rocket can be erratic, such that it can be difficult to deploy the line charge exactly where needed.

Further, the ballistic rocket can only deploy the line charge in a straight line, limiting its effectiveness on curved roadways. In addition, the length of line charge that such systems can deploy is limited due to the limits on the thrust of the rocket motor. Also, the use of expendable ballistic rockets make such systems relatively expensive compared to other mine-clearing systems.

Thus, there is a need for a mine clearance system and method that can be deployed remotely so as to provide personnel safety. The mine clearing system and method should minimize damage to mine clearing equipment, while including inexpensive, replaceable components. The mine clearing system and method should provide for accurate placement of long lengths of line charges, including placement on curved paths and rough terrain.

SUMMARY OF THE INVENTION

It is therefore a general purpose and primary object of the present invention to provide a mine clearing system and method that will remotely deploy detonating cord or a line charge from a reloadable, though expendable, remotely controlled vehicle.

The vehicle can include two wheels connected together via a central hub shaft. Each wheel can include a hub motor.

The individual hub motors can communicate to a central controller and receiver mounted inside the hollow central hub shaft. The hub motors can be battery operated and the power source for both motors can be contained within the central hub shaft. Battery recharge ports can be located on the central hub shaft. Detonating cord or other explosive line charge can be wrapped or spooled around the central hub shaft.

To deploy the system, an operator uses a remote control console in communication with the receiver and central controller in the hub shaft. The operator can independently control each wheel of the vehicle with a variable forward and reverse toggle.

A night vision camera can be attached to the hub shaft to broadcast signals from the vehicle to a display at the remote control console. The camera can be connected to a hub shaft bearing on the outside of one wheel so as to hang from the bearing and be gravitationally stabilized during movement of the vehicle. A second camera can be positioned at the opposite wheel to allow three-dimensional imagery to be incorporated into the remote control console display and provide the operator with depth perception.

When the vehicle is positioned at the beginning of the path to be cleared, the end of the line charge is staked into place to securely hold the end of line. The operator can then remotely maneuver the vehicle down the path to be cleared while laying down a continuous length of line charge.

In this manner, the full length of line charge can be remotely and precisely laid out along a roadway suspected of containing mines or IEDs. The remote operation of the vehicle allows for negotiating curves and avoiding obstacles. After paying out the full length of line charge the emptied vehicle can be remotely moved to a safe location and the line charge can then be initiated to explode any mines along the path.

In one embodiment, a system for clearing land mines includes a remotely controlled vehicle, a length of line hose spooled onto the vehicle, a remote controller in communication with the vehicle and an explosive slurry mixture pumped into said line hose. The vehicle responds to signals from the remote controller so as to move in a desired direction. The movement of the vehicle pays out the line hose from the vehicle.

The vehicle can further include two wheels, a tubular axle connected between the two wheels and a hub motor at each one of the two wheels. The line hose is spooled about the axle and the hub motor responds to the signals from the remote controller to rotate a respective wheel so as to produce the movement of the vehicle.

The system can further include a first camera disposed on the vehicle and in communication with the remote controller. Video signals from the first camera are displayed on a video screen on the remote controller. The camera is supported from an axle bearing connected to one of the two wheels at a rotation axis of the wheel, such that the axle bearing freely rotates about the rotation axis. A rod connects the camera to the axle bearing.

The system can include a second camera supported from a second axle bearing at the opposite wheel such that the video screen can display three dimensional images based on combined video signals from the first and second cameras. The cameras can be night vision cameras.

The vehicle can further include a receiver and a power source mounted within the axle. The receiver can be in communication with the remote controller and the hub motors. The power source can power the receiver, the cameras, and the hub motors. The vehicle can further include quick disconnect fittings between the axle and the wheels and also include a charging outlet for the power source.

The system can also include a reservoir of the explosive slurry mixture and a pump connected between the reservoir and the line hose. The line hose is filled with the slurry mixture by operation of the pump.

In one embodiment, a method of conducting a clearing operation of a mined area includes deploying a remotely controlled vehicle to a cleared area adjacent the mined area and securing a free end of a line hose that has been spooled about an axle of the vehicle. The vehicle is remotely maneuvered through the land mined area so as to pay out the line hose from the vehicle during its maneuvering. The line hose is filled with explosive slurry and the slurry is detonated.

The method further includes paying out the full length of the line hose and remotely guiding the vehicle out of the mined area. The method can also include removing wheels from the vehicle so as to access the axle. The wheels can then be connected to a second axle having new line hose spooled thereon. Line hose can also be spooled onto the empty axle.

To fill the line hose, a pump is connected between a slurry reservoir and the free end of the line hose. Detonating the line hose can include disconnecting the pump and removing the pump to a safe area. Blasting caps can be attached to the line hose and the blasting caps can be activated to detonate the slurry within the line hose.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like references numerals and symbols designate identical or corresponding parts throughout the several views and wherein.

DESCRIPTION OF THE INVENTION

Figure 1:
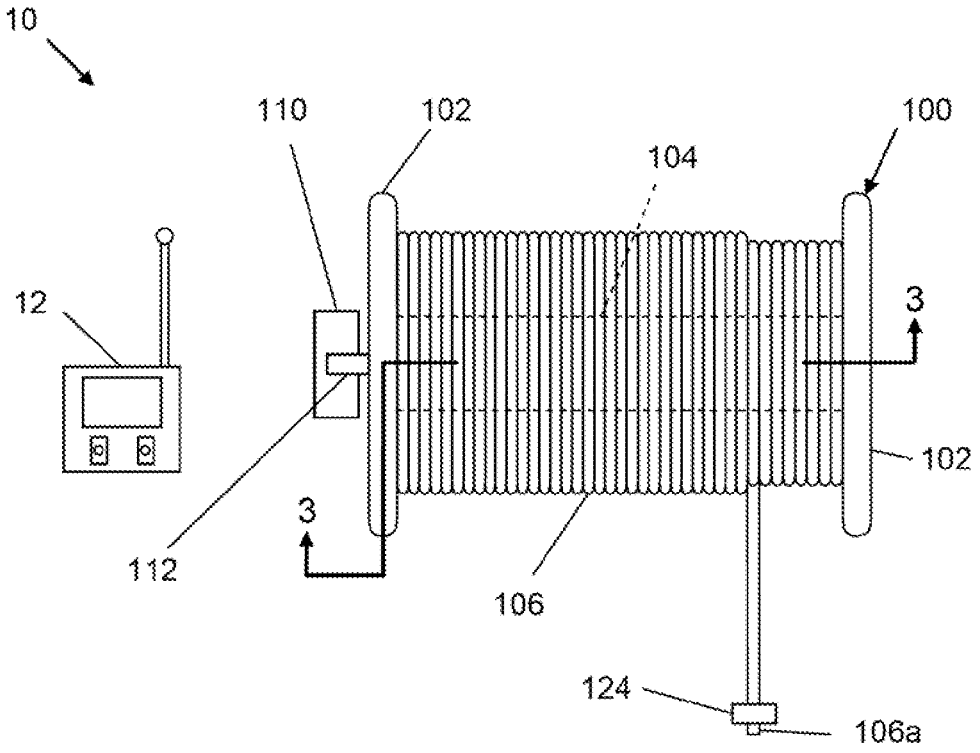
FIG. 1 illustrates a schematic view of a mine clearance system.
Figure 2:
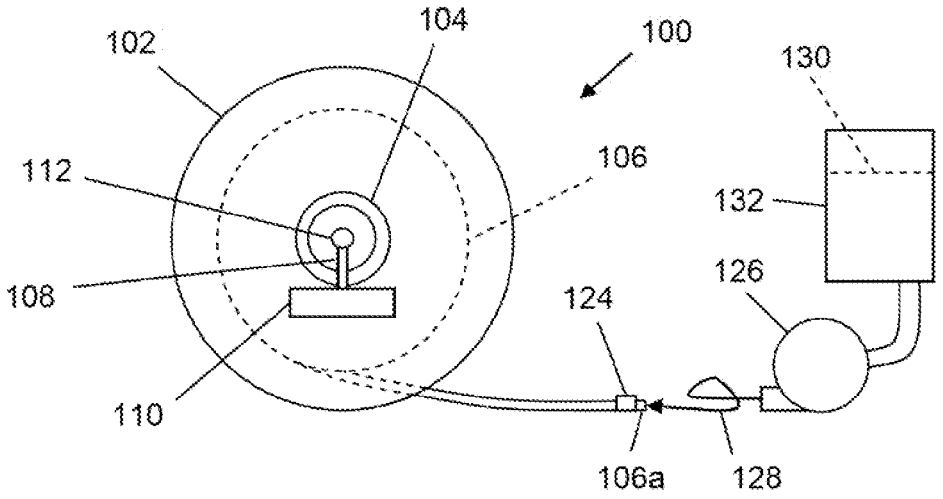
FIG. 2 illustrates a side view of the mine clearance vehicle of FIG. 1.

Referring now to FIG. 1, there is shown a schematic view of mine clearance system 10. System 10 includes remote controller 12 and vehicle 100 (shown in a top view in FIG. 1). Vehicle 100 includes two wheels 102 connected by central shaft 104 (shown in phantom in FIG. 1). Referring also to FIG. 2, there is shown a side view of vehicle 100. Line charge 106 (shown partially in phantom in FIG. 2) is wrapped about shaft 104. Arm 108 connects camera 110 to axle bearing 112.

Figure 3:
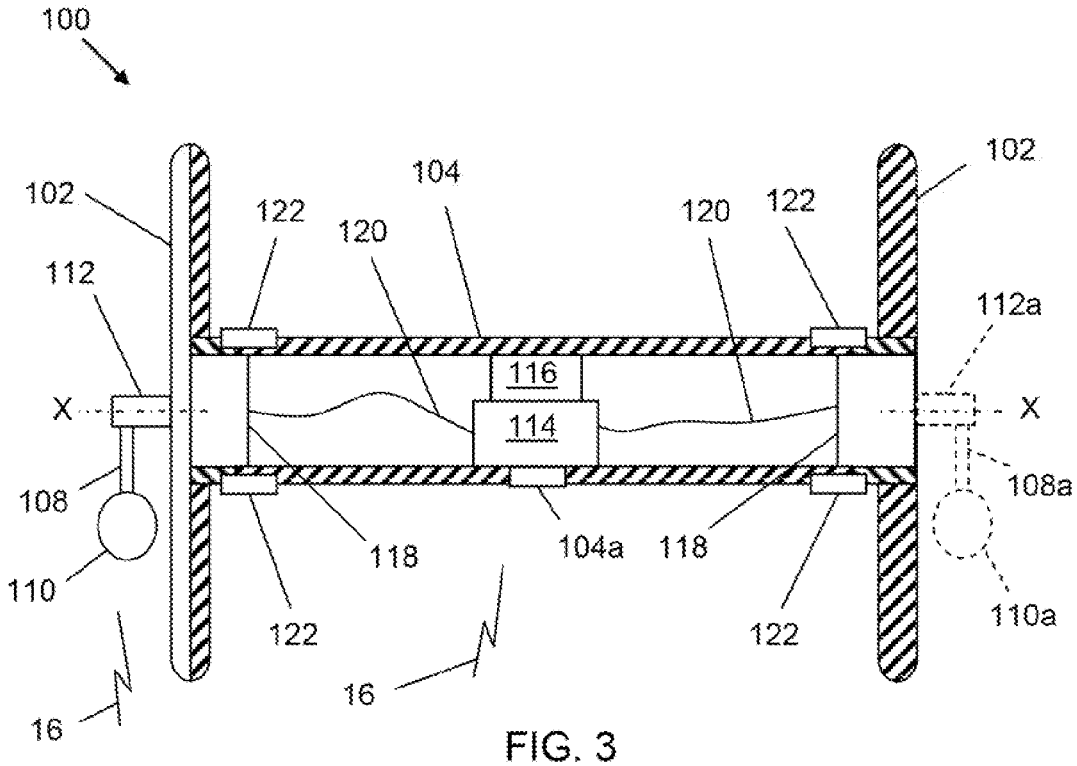
FIG. 3 illustrates a cross-sectional view of the mine clearance vehicle take at line 3-3 of FIG. 1.

Referring now also to FIG. 3, there is shown a cross-sectional view of vehicle 100 taken at line 3-3 of FIG. 1. For clarity of illustration, line charge 106 is not shown in FIG. 3. As shown in FIG. 3, shaft 104 is tubular. Power source 114 and central controller 116 are contained within shaft 104. Each wheel 102 includes an independently controlled hub motor 118, connected to power source 114 via wires 120. Shaft 104 is connected to wheels 102 and hub motors 118 via quick disconnect fittings 122. Axle bearing 112 extends from and is connected to hub motor 118 so as to be freely rotating about shaft axis X-X. Arm 108 is connected to axle bearing 112 and supports camera 110.

Figure 4:
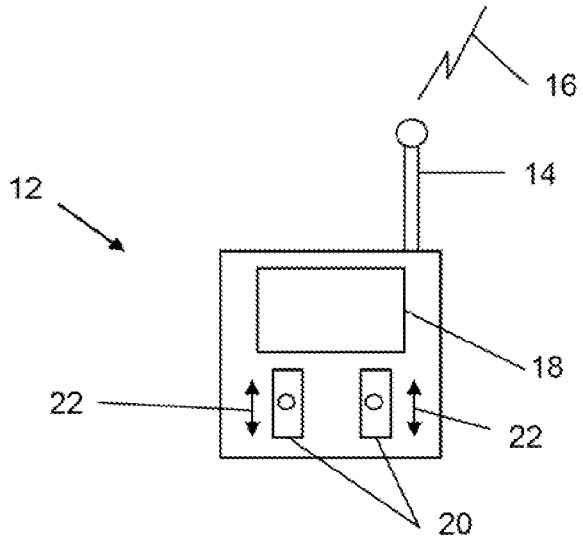
FIG. 4 is a detailed view of the remote controller of FIG. 1.

Referring also to FIG. 4, there is shown a detailed view of remote controller 12. Remote controller 12 is in communication with camera 110 and central controller 116, as indicated by antenna 14 and lines 16 (FIG. 3 and FIG. 4). Remote controller 12 receives signals from camera 110 and the resultant video is shown on display 18.

Each of two rocker switches 20 respectively controls one hub motor 118 on one wheel 102. Movement of a rocker switch 20 in a direction indicated by arrows 22 results in a signal being sent to central controller 116. Central controller 116 operates the respective hub motor 118 to rotate its connected wheel 102 in a corresponding direction.

Figure 5:
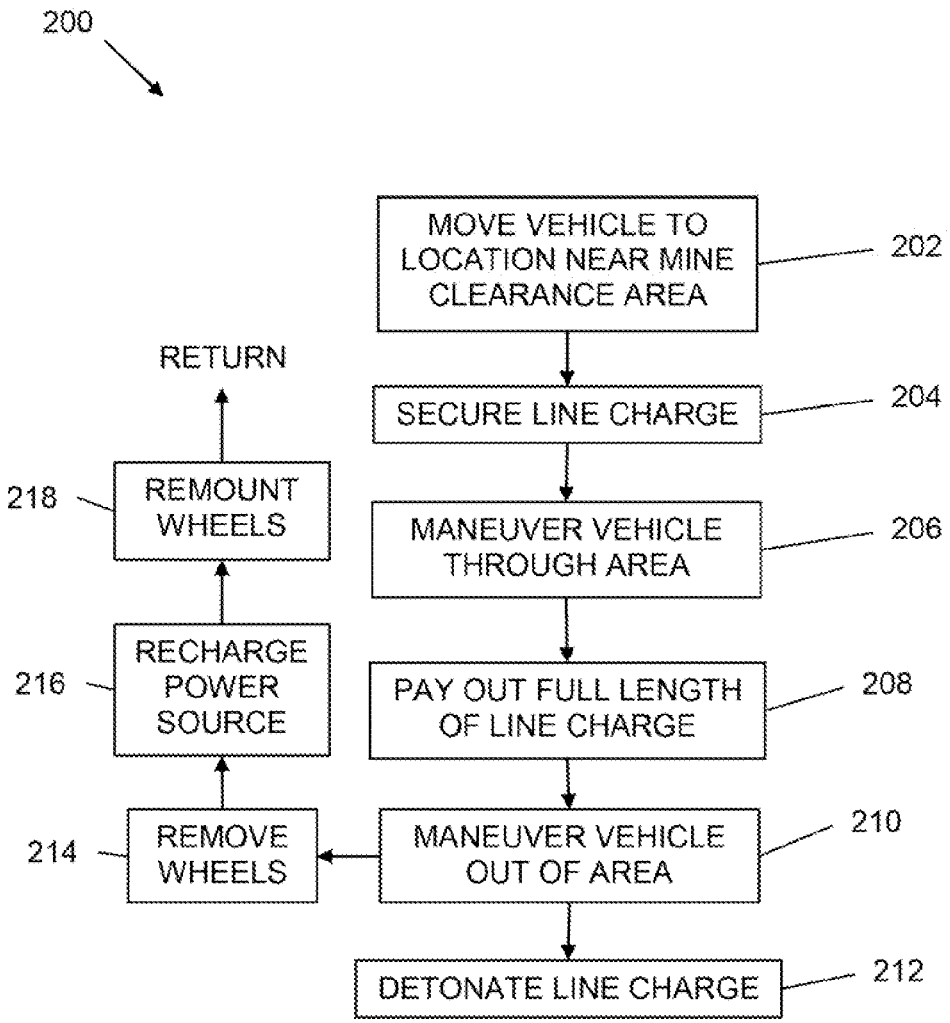
FIG. 5 is a block diagram of a method for clearing mines utilizing the system of FIG. 1.

Referring now to FIG. 5, there is shown a block diagram for a method 200 of deploying mine clearance system 10. At block 202, vehicle 100 is moved to a location near the area to be cleared of mines. Vehicle 100 can be off-loaded at the location from a transport, can be manually moved to the location, or an operator can utilize remote controller 12 to cause vehicle 100 to maneuver itself into position.

Once vehicle 100 is in position, end 106*a* of detonator cord 106 is secured to a fixed point (block 204), as illustrated by bar 124 shown in FIGS. 1 and 2. An operator uses remote controller 12 to maneuver vehicle 100 through the area to be cleared (block 206). Camera 110 provides the operator with a forward view to aid in maneuvering vehicle 100 around curves and obstacles, over hills and through areas hidden from the operator's sight.

Optionally vehicle 100 can include second camera 110*a*, connected to second axle bearing 112*a* by second rod 108*a* (shown in phantom in FIG. 3). As shown, second camera 110*a* can be mounted on vehicle 100 opposite camera 110. Accordingly, display 18 of remote controller 12 can incorporate three-dimensional imagery to provide the operator with depth perception. Additionally, cameras 110 and 110*a* can incorporate night vision capabilities to allow for nighttime operations.

As vehicle 100 moves, line charge 106 is paid out from shaft 104 (block 208). Once line charge 106 is fully paid out and off of shaft 104, vehicle 100 is maneuvered out of the mined area (block 210). With vehicle 100 away from the mined area, line charge 106 is detonated (block 212) so as to detonate any mines in the vicinity of line charge 106 and thus clear the area of mines.

Figure 6:
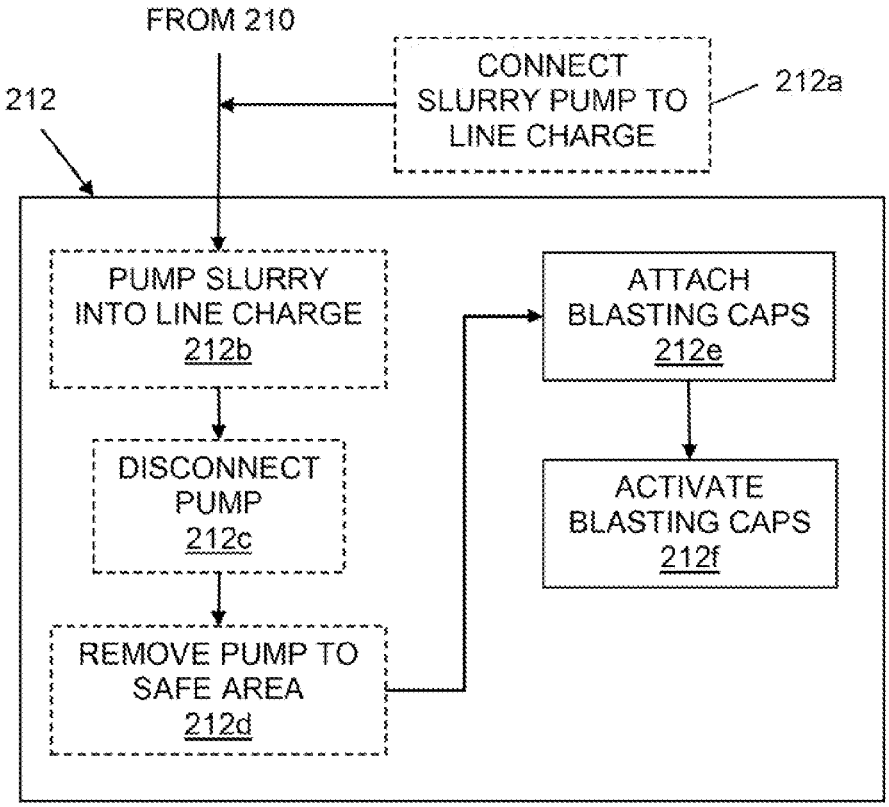
FIG. 6 is a block diagram of a method for detonating a slurry line charge

Line charge 106 can be one of many known explosive line charges or detonation cords currently used in mine clearing operations. Alternately, line charge 106 can include an empty length of hose that can be filled with explosive slurry. Referring to FIG. 6, there is shown a detailed block diagram of block 212 for detonating line charge 106. For the explosive slurry alternative, blocks in FIG. 6 are shown in phantom.

Slurry pump 126 (shown in FIG. 2) can be connected to line charge 106 (as illustrated by arrow 128 in FIG. 2 and at block 212*a* of FIG. 6). For illustration, but not limitation, slurry pump 126 is shown in FIG. 2 connected to line charge 106 prior to line charge 106 being paid out from vehicle 100. As indicated at block 212*a* of FIG. 6, connection 128 can be made at any time prior to and including maneuvering vehicle 100 from the area (block 210 in FIG. 5).

When the full length of line charge 106 is paid out and vehicle 100 is maneuvered out of the area (blocks 208 and 210 of FIG. 5), explosive slurry 130 (shown in phantom in FIG. 2 within reservoir 132) is pumped from reservoir 132 into line charge 106 via pump 126 (block 212*b*). When line charge 106 is full of slurry 130, pump 126 is disconnected (block 212*c*) and pump 126 is removed to a safe area (block 212*d*). To detonate line charge 106, line charge 106 is fitted with blasting caps or other suitable detonation means (block 212*e*). The detonation means are activated (block 212*f*) such that line charge 106 is detonated.

Since vehicle 100 is away from the mined area, vehicle 100 does not sustain damage when the line charge is detonated. With line charge 106 removed from shaft 104, quick disconnect fittings 122 can be accessed to remove wheels 102 from shaft 104 (block 214). Power source 114 of empty shaft 104 can be recharged (block 216) via charging port 104*a* (shown in FIG. 3) prior to re-installing a new line charge thereon. Wheels 102 can be remounted onto a replacement shaft that has a new line charge wrapped thereon (block 218). A new mine clearing operation can then begin, again using vehicle 100.

What have thus been described are a mine clearing system 10 and method 200 that remotely deploys detonating cord or line charge 106 from a reloadable, though expendable, remotely controlled vehicle 100. Vehicle 100 can include two wheels 102 connected together via a central hub shaft 104. Each wheel 102 can include a hub motor 118. Individual hub motors 118 can communicate to a central controller and receiver 116 mounted inside the hollow central hub shaft 104.

The hub motors 118 can be battery operated and the power source 114 for both motors 118 can be contained within the central hub shaft 104. A battery recharge port 104*a* can be located on the central hub shaft 104. Detonating cord or other explosive line charge 106 can be wrapped around the central hub shaft 104.

To deploy system 10, an operator uses a remote control console 12 in communication with the receiver and central controller 116 in the hub shaft 104. The operator can independently control each wheel 102 of the vehicle 100 with variable forward and reverse toggles 20.

A night vision camera 110 can be attached to the hub shaft 104 to broadcast signals 16 from the vehicle 100 to a display 18 at the remote control console 12. The camera 110 can be connected to a hub shaft bearing 112 on the outside of one wheel 102 so as to hang from the bearing 112 and be gravitationally stabilized during movement of the vehicle 110. A second camera 110*a* can be positioned at the opposite wheel 102 to allow three-dimensional imagery to be incorporated into the remote control console display 18 and provide the operator with depth perception.

When the vehicle 100 is positioned at the beginning of the path to be cleared (202), the end 106*a* of the line charge 106 is staked into place to securely hold the end of line (204). The operator can then remotely maneuver the vehicle 110 down the path to be cleared (206) while laying down a continuous length of line charge 106.

In this manner, the full length of line charge 106 can be remotely and precisely laid out along a mined roadway, including negotiating curves and avoiding obstacles (208). After paying out the full length of line charge 106, the emptied vehicle 100 can be remotely moved to a safe location (210) and the line charge 106 can then be detonated (212) by attaching (212*e*) and activating (212*f*) blasting caps, as is known in the art.

To detonate a slurry system, a pump 126 is connected (212*a*) between a reservoir 132 and empty line charge hose 106. Slurry 130 from the reservoir 132 is pumped into line charge 106 (block 212*b*). When line charge 106 is filled with slurry 130, pump 126 is disconnected (212*c*) from line charge 106 and moved to a safe area (212*d*). Line charge 106 can then be detonated in the known manner of attaching (212*e*) and activating (212*f*) blasting caps.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A system for clearing land mines, comprising:

a remotely controlled vehicle;

a length of line hose spooled onto said vehicle;

a remote controller in communication with said vehicle, said vehicle responding to signals from said remote controller to move in a desired direction, movement of said vehicle paying out said line hose from said vehicle; and an explosive slurry mixture contained within said line hose.

2. The system of claim 1, wherein said vehicle further comprises:

two wheels;

a tubular axle connected between said two wheels, said line hose being spooled about said axle; and a hub motor at each of said two wheels, each said hub motor responding to said signals to rotate a respective wheel to produce said movement of said vehicle.

3. The system of claim 2, further comprising:

a first camera disposed on said vehicle and in communication with said remote controller; and a video screen on said remote controller, video signals from said first camera being displayed on said video screen.

4. The system of claim 3, further comprising:

a first axle bearing connected to one of said two wheels at a rotation axis of said one wheel, said first axle bearing freely rotating about said rotation axis; and a rod connected between said first axle bearing and said first camera to support said first camera.

5. The system of claim 4, wherein said first camera is a night vision camera.

6. The system of claim 4, further comprising:

a second camera disposed on said vehicle, said video screen displaying three dimensional images based on combined video signals from said first and second cameras;

a second axle bearing connected to an opposite one of said two wheels along said rotation axis and freely rotating about said rotation axis; and a second rod connected between said second axle bearing and said second camera to support said second camera.

7. The system of claim 3, wherein said vehicle further comprises:

a receiver mounted within said axle and in communication with said remote controller and each said hub motor; and a power source mounted within said axle and connected to provide power to said receiver, said first camera and each said hub motor.

8. The system of claim 7, further comprising a quick disconnect fitting between said axle and each of said two wheels.

9. The system of claim 7, further comprising a charging outlet for said power source.

10. The system of claim 1, further comprising:

a reservoir of said explosive slurry mixture; and a pump connected between said reservoir and said line hose, wherein said line hose is filled with said slurry mixture by operation of said pump.

11. A method of clearing land mines from an area, comprising:

deploying a remotely controlled vehicle to a cleared area adjacent said mined area, said vehicle having a line hose spooled on a first axle thereof;

securing a free end of said line hose;

remotely maneuvering said vehicle through said mined area, said line hose being paid out from said vehicle during said maneuvering;

filling said line hose with an explosive slurry; and detonating said slurry.

12. The method of claim 11, wherein maneuvering further comprises:

paying out a full length of said line hose; and remotely guiding said vehicle out of said mined area.

13. The method of claim 12, further comprising:

removing wheels from said vehicle to access said first axle;

connecting a second axle to said wheels, said second axle having new line hose spooled thereon; and spooling further line hose onto said first axle.

14. The method of claim 11, wherein filling said line hose comprises connecting a pump between a slurry reservoir and said free end of said line hose.

15. The method of claim 14, wherein detonating further comprises:

disconnecting said pump;

removing said pump to an area not effected by said detonating;

attaching blasting caps to said line hose; and activating said blasting caps to detonate said slurry.

* * * * *